US006973966B2

(12) United States Patent
Szarka

(10) Patent No.: US 6,973,966 B2
(45) Date of Patent: Dec. 13, 2005

(54) COMPRESSIBLE DARTS AND METHODS FOR USING THESE DARTS IN SUBTERRANEAN WELLS

(75) Inventor: David D. Szarka, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 125 days.

(21) Appl. No.: 10/714,832

(22) Filed: Nov. 14, 2003

(65) Prior Publication Data

US 2005/0103504 A1 May 19, 2005

(51) Int. Cl.[7] ..... E21B 33/00
(52) U.S. Cl. ..... 166/153; 166/156
(58) Field of Search ..... 166/152, 153, 166/154, 165, 177.4

(56) References Cited

U.S. PATENT DOCUMENTS

| | | | | |
|---|---|---|---|---|
| 4,345,402 A | | 8/1982 | Hanson et al. | 46/206 |
| 4,378,838 A | | 4/1983 | Ogden et al. | 166/153 |
| 4,545,434 A | | 10/1985 | Higgins | 166/217 |
| 5,036,922 A | | 8/1991 | Braddick | 166/383 |
| 5,311,940 A | * | 5/1994 | LaFleur | 166/152 |
| 5,433,270 A | | 7/1995 | LaFleur | 166/152 |
| 5,435,386 A | * | 7/1995 | LaFleur | 166/156 |
| 5,829,523 A | | 11/1998 | North | 166/250.14 |
| 5,928,049 A | * | 7/1999 | Hudson | 446/4 |
| 5,979,557 A | * | 11/1999 | Card et al. | 166/300 |
| 6,725,917 B2 | * | 4/2004 | Metcalfe | 166/153 |
| 6,880,636 B2 | * | 4/2005 | Rogers et al. | 166/290 |

FOREIGN PATENT DOCUMENTS

EP 1 126 131 A1 8/1991 ..... E21B 43/26

OTHER PUBLICATIONS

Brochure entitled "Landing Nipples and Lock Mandrels," from Otis Engineering Corp., General Sales Catalog.
Halliburton Casing Sales Manual, Section 4.14, "SSR Plug Releasing Darts".
Foreign communication from a related counterpart application dated Feb. 2, 2005.

* cited by examiner

*Primary Examiner*—William Neuder
(74) *Attorney, Agent, or Firm*—John W. Wustenberg; Baker Botts, L.L.P.

(57) ABSTRACT

The present invention relates generally to subterranean well construction, and more particularly, to improved darts and methods of using these darts in subterranean wells. In one embodiment, the present invention provides a dart for activating a plug located within a subterranean well bore, the dart comprising a mandrel, and a foam body attached to the mandrel. Optionally, an elastic tether can be included, inter alia, to absorb the deformation of the foam body.

68 Claims, 1 Drawing Sheet

COMPRESSIBLE DARTS AND METHODS FOR USING THESE DARTS IN SUBTERRANEAN WELLS

BACKGROUND

The present invention relates generally to subterranean well construction, and more particularly, to improved darts and methods of using these darts in subterranean wells.

During the drilling and construction of subterranean wells, casing strings are generally introduced into the well bore. To stabilize the casing, a cement slurry is often pumped downwardly through the casing, and then upwardly into the annulus between the casing and the walls of the well bore. One concern in this process is that, prior to the introduction of the cement slurry into the casing, the casing generally contains a drilling or some other servicing fluid that may contaminate the cement slurry. To prevent this contamination, a subterranean plug, often referred to as a cementing plug or a "bottom" plug, may be placed into the casing ahead of the cement slurry as a boundary between the two. The plug may perform other functions as well, such as wiping fluid from the inner surface of the casing as it travels through the casing, which may further reduce the risk of contamination.

Similarly, after the desired quantity of cement slurry is placed into the well bore, a displacement fluid is commonly used to force the cement into the desired location. To prevent contamination of the cement slurry by the displacement fluid, a "top" cementing plug may be introduced at the interface between the cement slurry and the displacement fluid. This top plug also wipes cement slurry from the inner surfaces of the casing as the displacement fluid is pumped downwardly into the casing. Sometimes a third subterranean plug may be used, to perform functions such as preliminarily calibrating the internal volume of the casing to determine the amount of displacement fluid required, for example, or to separate a second fluid ahead of the cement slurry (e.g., where a preceding plug may separate a drilling mud from a cement spacer fluid, the third plug may be used to separate the cement spacer fluid from the cement slurry), for instance.

In certain applications, for example, when drilling offshore, the casing string may be lowered into the hole by a work string, which is typically a length of drill pipe. Because most subterranean plugs are too large to pass through the work string, sub-surface release ("SSR") subterranean plugs are used. These plugs are often suspended at the interface of the drill pipe and the casing string, and are selectively released by a remote device when desired. Because SSR subterranean plugs are suspended at the interface between the work string and the casing, fluids must be able to pass through the plugs. However, when used to prevent contamination as described above, the channels through the plugs must be selectively sealed.

Several methods are known in the art for sealing the channels through SSR plugs. For example, if the channel is funnel-shaped, then a weighted ball may be dropped into the funnel in the plug to seal it. Another method involves a positive displacement plugging device, often referred to as a "dart." Darts generally comprise two or more rubber "fins" that flare outwardly from a mandrel. Such fins are generally sized so as to engage the inside wall of the pipe in which they are deployed. Because its fins prevent a dart from free-falling to the plug, a pressure differential usually is applied to force the dart to the plug.

When used to release subterranean plugs, the fins of a dart must collapse or compress sufficiently to allow the dart mandrel to advance through the work string and reach the intended plug. In some instances where there is a plurality of subterranean plugs, each succeeding plug may have a successively smaller minor diameter channel such that successively larger dart noses can be used to release the subterranean plugs in sequence. Thus, a particular dart must be capable of collapsing to a small enough diameter to reach an intended plug. Several problems, however, have been encountered with conventional darts in such applications. For instance, when a conventional dart has fins that are properly sized to engage the inside wall of the work string, such fins may approach an equivalent solid mass when compressed while passing through the minor diameter of successively smaller plugs; accordingly, excessive pressure may be required to push the dart (having fins in such compressed state) to the desired plug. Using excessive pressure is undesirable, because such excessive pressure may cause the cementing plug to be released prematurely and/or out of the desired sequence. Moreover, a dart with easily-compressible fins generally does not adequately engage the inner wall of the drill string and, therefore, does not act as an effective wiping device.

SUMMARY

The present invention relates generally to subterranean well construction, and more particularly, to improved darts and methods of using these darts in subterranean wells.

In one embodiment, the present invention provides a dart for activating a subterranean plug located within a subterranean well bore, the dart comprising a mandrel, and a foam body attached to the mandrel. Optionally, an elastic tether can be included, inter alia, to strengthen the attachment of the mandrel to the foamed outer body.

In one embodiment of the methods of the present invention, a method of activating a subterranean plug located within a subterranean well bore comprises the step of introducing a dart into a fluid passage within the device, wherein the dart comprises a mandrel and a foam body attached to the mandrel.

The features and advantages of the present invention will be readily apparent to those skilled in the art upon a reading of the description of the preferred embodiments that follows.

BRIEF DESCRIPTION OF THE DRAWINGS

A more complete understanding of the present disclosure and advantages thereof may be acquired by referring to the following description taken in conjunction with the accompanying drawing, wherein.

Figure 1:
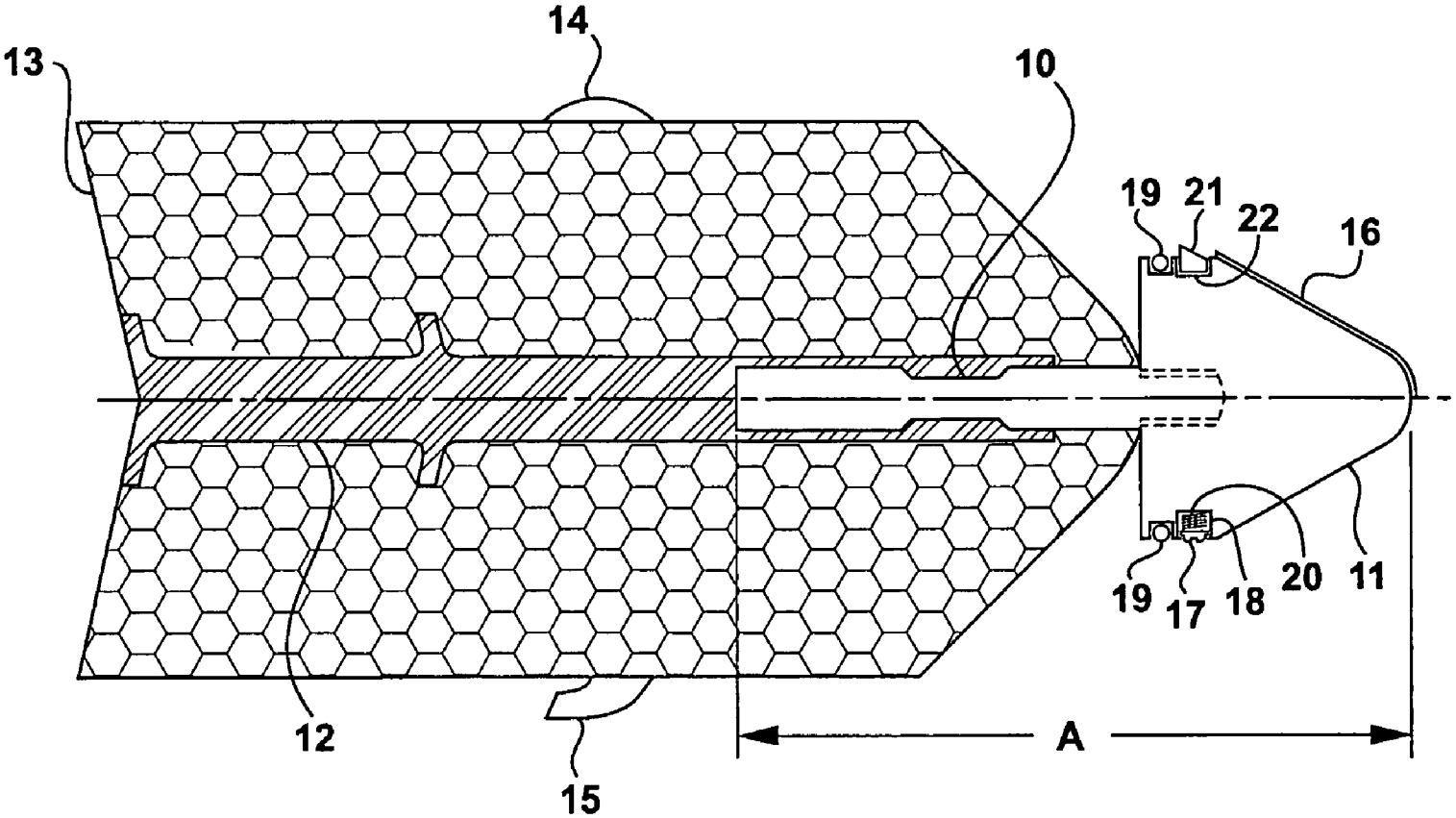
FIG. 1 is a side cross-sectional view of an exemplary embodiment of the darts of the present invention.

While the present invention is susceptible to various modifications and alternative forms, specific exemplary embodiments thereof have been shown by way of example in the drawing and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION

The present invention relates generally to subterranean well construction, and more particularly, to improved darts and methods of using these darts in subterranean wells.

An exemplary embodiment of a dart of the present invention is depicted in FIG. 1. Foam body 13 comprises within it mandrel 10. Mandrel 10 is constructed from any material suitable for use in the subterranean environment in which the dart will be placed. In certain exemplary embodiments, mandrel 10 comprises a drillable material. Examples of a suitable material include but are not limited to plastics, phenolics, composite materials, high strength thermoplastics, aluminum, glass, and brass. Although mandrel 10 is shown in FIG. 1 as being generally cylindrical, other shapes also are suitable. For example, in certain exemplary embodiments of the present invention, mandrel 10 has the shape of a column. In certain exemplary embodiments, mandrel 10 has the shape of a column with a circular cross-section. In certain exemplary embodiments of the present invention, the outer surface of mandrel 10 may comprise one or more ribs, or have an otherwise varying outer circumference along its length, such that elastic tether 12 and/or foam body 13 may be adequately engaged to mandrel 10 for a given application. In certain exemplary embodiments, a leading end of mandrel 10 may be shaped into a nosepiece as shown at 11 in FIG. 1, which nosepiece 11 is adapted to sealingly engage a subterranean plug. Accordingly, in certain exemplary embodiments of the present invention, mandrel 10 and nosepiece 11 may be an integral unit. In certain exemplary embodiments of the present invention, nosepiece 11 has an outer diameter that is smaller than the outer diameter of foam body 13.

In certain other exemplary embodiments, nosepiece 11 may be a separate component that is attached to a leading end of mandrel 10. Nosepiece 11 can be manufactured from any material suitable for use in the subterranean environment in which the dart will be placed. In certain exemplary embodiments, nosepiece 11 comprises a drillable material. Examples of a suitable material include but are not limited to plastics, phenolics, composite materials, high strength thermoplastics, aluminum, glass, and brass. Generally, any material suitable for constructing mandrel 10 will be suitable for constructing nosepiece 11. In certain exemplary embodiments, the leading end of mandrel 10 and an inner bore of nosepiece 11 may both be threaded, which will, among other benefits, facilitate the use of other shaped nosepieces, in accordance with the requisite shape dictated by the plug with which the dart will interact. One of ordinary skill in the art with the benefit of this disclosure will recognize the appropriate shape or configuration of nosepiece 11 relative to mandrel 10 that will be appropriate for a given application. In certain exemplary embodiments, a leading end of nosepiece 11 may be somewhat tapered, which will, among other benefits, facilitate the entry of the dart into the plug.

In certain exemplary embodiments, nosepiece 11 will sealingly engage a receiving configuration within the subterranean plug. Additionally, certain exemplary embodiments of nosepiece 11 may comprise latch 21; in such embodiments, the receiving configuration within the subterranean plug will be configured with a matching latch down profile. Generally, latch 21 may comprise any self-energized device designed so as to engage and latch with a matching latch down receiving configuration in a subterranean plug. In certain exemplary embodiments, latch 21 may comprise a self-energized "C" ring profile that can be attached to a dart of the present invention by expanding the "C" ring profile over the major outer diameter of nosepiece 11 so as to lodge in groove 22 on such outer diameter. In certain exemplary embodiments, latch 21 may comprise a self-energized collet type latch ring; in such embodiments, nosepiece 11 will generally comprise a threaded element, separate from mandrel 10, to facilitate installation of the collet type latch ring. One of ordinary skill in the art with the benefit of this disclosure will be able to recognize an appropriate latch device for a particular application. Nosepiece 11 may, in certain exemplary embodiments, be coated with elastomeric compound 16 or fitted with one or more seal rings 19, to enhance sealing within the plug. In certain exemplary embodiments of the present invention, seal rings 19 comprise elastomeric "O" rings; in certain of these exemplary embodiments, seal rings 19 may be made from a material such as a fluoro-elastomer, nitrile rubber, VITON™, AFLAS™, TEFLON™, or the like. In certain exemplary embodiments of the present invention, seal rings 19 comprise chevron-type "V" rings. One of ordinary skill in the art, with the benefit of this disclosure, will be able to recognize applications where the use of seal rings 19 may be appropriate, and will further recognize the appropriate type and material for a particular application. Alternatively, nosepiece 11 may be fitted with one or more uniquely shaped keys 17 that will selectively engage with a matching uniquely shaped receiving profile in the receiving configuration of a particular plug. In certain exemplary embodiments wherein multiple plugs are present in the subterranean formation, the use of uniquely shaped keys 17 and matching uniquely shaped receiving profiles will permit the receiving configurations of all plugs to have a common minimum inner diameter. Spring 20 binds uniquely shaped keys 17 within windows 18 while permitting uniquely shaped keys 17 to move radially between contracted "pass-through" positions (e.g., a position permitting uniquely shaped keys 17 to pass through a prescribed minimum inner diameter until such time as uniquely shaped keys 17 contact a matching uniquely shaped receiving profile that permits uniquely shaped keys 17 to move into their expanded latching position and thereby lock into such position) and expanded latching positions.

In certain exemplary embodiments of the present invention, the effective combined length of the mandrel 10 and nosepiece 11, which effective combined length is indicated by dimension "A" in FIG. 1, should exceed the inside diameter of the largest restriction through which the dart will pass. This is, inter alia, to prevent the dart from being inverted within the drill-pipe into which it has been deployed. In certain exemplary embodiments wherein mandrel 10 and nosepiece 11 are separately formed pieces that have been threaded together, their "effective combined length" will be understood to refer to their combined length when assembled, rather than when measured separately (e.g., the portion of the length of either piece that is lost due to thread makeup is not included in the effective combined length). An example of a suitable effective-combined-length-to-diameter differential is about 25%. The specific differential will depend on the exact application to which the dart will be put. For example, in certain exemplary embodiments of the present invention wherein a dart of the present invention is used within a 6⅝ inch, 25.2 lb/ft drill pipe having a nominal inner diameter of 5.965 inches, dimension "A" of the dart may be a minimum of 7.46 inches in length. One of ordinary skill in the art with the benefit of this disclosure will recognize the appropriate effective-combined-length-to-diameter differential for a particular application.

As shown in FIG. 1, in certain exemplary embodiments of the present invention, an elastic tether 12 may be used as a component of the dart assembly. If used, elastic tether 12 preferably is attached to mandrel 10 and to foam body 13. Among other benefits, elastic tether 12 serves to absorb the deformations in foam body 13 that may result as the dart passes through restrictive areas, e.g., a work string, which may reduce the risk of separation of foam body 13 from mandrel 10. Elastic tether 12 can be fabricated from any material suitable for use in the subterranean environment to which the dart will be put, which material also has sufficient elastic properties. Examples of suitable materials include but are not limited to natural rubber, nitrile rubber (or any other synthetic, elastomeric rubber), polyurethane, elastic fabrics, or the like. In certain exemplary embodiments of the present invention, elastic tether 12 is molded around and bonded to mandrel 10, and the inner surface of elastic tether 12 conforms to and is bonded to the outer surface of mandrel 10. In like manner, the outside surface of elastic tether 12 conforms to and is bonded to the inner surface of foam body 13. Elastic tether 12 is generally cylindrical, but other shapes will also serve to attach foam body 13 and mandrel 10 to elastic tether 12. For example, in certain exemplary embodiments of the present invention, elastic tether 12 has the shape of a column. In certain exemplary embodiments of the present invention, elastic tether 12 has the shape of a column with a circular cross-section. One of ordinary skill in the art with the benefit of this disclosure will recognize the appropriate shape for elastic tether 12 for a given application. In certain exemplary embodiments of the present invention, the outer surface of elastic tether 12 may also be ribbed, or have an otherwise varying outer circumference along its length, such that foam body 13 is more securely engaged with elastic tether 12.

Foam body 13 may be constructed from any foamable material such as an elastomer including but not limited to open-cell foams comprising natural rubber, nitrile rubber, styrene butadiene rubber, polyurethane, or the like. Any open-cell foam having a sufficient density, firmness, and resilience may be suitable for the desired application. One of ordinary skill in the art with the benefit of this disclosure will be able to determine the appropriate construction material for foam body 13 given the compression and strength requirements of a given application. In certain exemplary embodiments of the present invention, foam body 13 comprises an open-cell, low-density foam. Foam body 13 generally should be sized to properly engage the inner wall of the largest diameter through which the dart will pass; in certain exemplary embodiments of the present invention, foam body 13 wipes clean the inner wall of the drill pipe as the dart travels the length of the drill pipe, which length generally may extend the entire length of the well bore. Foam body 13 should also readily compress to pass through relatively small diameter restrictions without requiring excessive differential pressure to push the dart to the desired location. Among other benefits, the dart of the present invention may be used to wipe clean the inner wall of a drill pipe having an inner diameter that varies along its length.

In certain exemplary embodiments of the present invention, foam body 13 has a substantially cylindrical shape with a tapered leading edge. In certain exemplary embodiments of the present invention, foam body 13 may have a constant cross-section. In certain other exemplary embodiments of the present invention, the outer surface of foam body 13 may comprise one or more ribs 14 or fins 15; accordingly, in these and other embodiments foam body 13 may have a variable cross-section. Generally, the outside diameter of foam body 13 exceeds the outside diameter of nosepiece 11. Foam body 13 may be molded around and bonded to mandrel 10. If elastic tether 12 is used, then foam body 13 may also be bonded to elastic tether 12. In certain exemplary embodiments of the present invention, the inner surface of foam body 13 may conform to and sealingly engage the outer surface of mandrel 10 and elastic tether 12.

The darts of the present invention may be introduced into the subterranean plug in a variety of ways. For example, a dart may be introduced into a drill pipe within a well bore at the surface and then pumped down through the drill pipe until it contacts the plug. Alternatively, a differential pressure may be applied to the dart to cause it to travel through the drill pipe until it contacts the plug. Once nosepiece 11 has contacted its mating seat profile within the subterranean plug, a differential pressure may be applied across the sealing diameter of nosepiece 11 and its mating seat profile so as to activate the plug. As referred to herein, the term "activate" will be understood to mean causing the plug to be deployed so as to carry out an intended function within the drill pipe. For example, a plug may be activated so as to cause it to detach from a work string and travel through the drill pipe in order to serve as a spacer between different fluids that are desirably segregated.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of activating a plug located within a subterranean well bore comprising the step of introducing a dart into a receiving configuration within the plug, wherein the dart comprises a mandrel and a foam body attached to the mandrel, and further comprising the step of applying a differential pressure across the dart to activate the plug.

2. The method of claim 1 further comprising the step of applying a differential pressure across the dart to force the dart to travel through the well bore.

3. The method of claim 1 wherein the mandrel of the dart comprises a drillable material.

4. The method of claim 3 wherein the drillable material is selected from the group consisting of: aluminum, plastic, brass, a phenolic, a high-strength thermoplastic, glass, and a composite.

5. The method of claim 1 wherein the dart further comprises an elastic tether attached to the mandrel and to the foam body.

6. The method of claim 5 wherein the elastic tether is made from a material selected from the group consisting of: natural rubber, a synthetic elastomeric rubber, polyurethane, and elastic fabrics.

7. The method of claim 1 wherein a leading end of the mandrel comprises a nosepiece, the nosepiece being configured to sealingly engage within a receiving configuration in the subterranean plug.

8. The method of claim 7 wherein the nosepiece comprises a drillable material.

9. The method of claim 8 wherein the drillable material is selected from the group consisting of: aluminum, plastic, brass, a phenolic, a high-strength thermoplastic, glass, and a composite.

10. The method of claim 7 wherein the nosepiece is threadably attached to the leading end of the mandrel.

11. The method of claim 7 wherein the nosepiece is integrally formed with the mandrel.

12. The method of claim 1 wherein the foam body comprises a foamable elastomer.

13. The method of claim 12 wherein the foamable elastomer comprises an open-cell foam.

14. The method of claim 13 wherein the open-cell foam is made from a material selected from the group consisting of: natural rubber, nitrile rubber, styrene butadiene rubber, and polyurethane.

15. The method of claim 14 wherein the open-cell foam is a low-density foam.

16. The method of claim 7 wherein the nosepiece has a tapered leading end.

17. The method of claim 1 wherein the foam body has a substantially cylindrical shape.

18. The method of claim 17 wherein the foam body has an outer diameter and a length, and wherein the outer diameter of the foam body is substantially constant along its length.

19. The method of claim 17 wherein the foam body has an outer diameter and a length, and wherein the outer diameter of the foam body varies along its length.

20. The method of claim 19 wherein the foam body comprises a rib or a fin.

21. The method of claim 7 wherein the nosepiece is configured with at least one uniquely shaped key that will selectively engage with a matching uniquely shaped profile within the receiving configuration in the subterranean plug.

22. The method of claim 21 wherein the subterranean well bore comprises at least one additional plug, further comprising the step of introducing at least one additional dart into a receiving configuration of the at least one additional plug, wherein the nosepiece of the at least one additional dart is configured with at least one uniquely shaped key that will selectively engage with a matching uniquely shaped receiving configuration within the subterranean plug.

23. The method of claim 22 wherein the receiving portion of each plug has a common minimum inner diameter.

24. The method of claim 7 wherein the nosepiece is configured with a latch down profile that will latch into a matching profile within the receiving configuration within the subterranean plug.

25. The method of claim 7 wherein the nosepiece is coated with an elastomeric compound.

26. The method of claim 7 wherein the nosepiece comprises a seal ring.

27. The method of claim 7 wherein the well bore further comprises at least one pipe string, wherein each of the at least one pipe strings has an inner diameter, wherein the nosepiece and the mandrel when combined together have an effective combined length, and wherein their effective combined length exceeds the largest inner diameter of the at least one pipe string.

28. The method of claim 2 wherein the well bore further comprises at least one pipe string, wherein the foam body has an outer surface, and wherein the outer surface of the foam body engages the inner diameter of the at least one pipe string as it travels through the at least one pipe string.

29. The method of claim 28 wherein the at least one pipe string has a length, and wherein the inner diameter of the at least one pipe string varies along its length.

30. The method of claim 7 wherein the nosepiece has an outer diameter, and wherein the outer diameter of the nosepiece is smaller than the outer diameter of the foam body.

31. The method of claim 24 wherein the latch down profile comprises a self-energized device.

32. The method of claim 31 wherein the self-energized device is selected from the group consisting of: a "C" ring, and a collet type latch ring.

33. The method of claim 2 wherein the well bore further comprises at least one pipe string; wherein each of the at least one pipe strings has an inner diameter; wherein the mandrel of the dart comprises a drillable material; wherein the dart further comprises an elastic tether attached to the mandrel and to the foam body; wherein a leading end of the mandrel comprises a nosepiece, the nosepiece being configured to sealingly engage within a receiving configuration in the subterranean plug; wherein the nosepiece comprises a drillable material; wherein the foam body comprises a foamable elastomer; wherein the nosepiece and the mandrel when combined together have an effective combined length, and wherein their effective combined length exceeds the largest inner diameter of the at least one pipe string; wherein the foam body has an outer surface, and wherein the outer surface of the foam body engages the inner diameter of the at least one pipe string as it travels through the at least one pipe string.

34. A dart for activating a subterranean plug located within a subterranean well bore comprising: a mandrel; a foam body attached to the mandrel; and an elastic tether attached to the mandrel and to the foam body.

35. The dart of claim 34 wherein a leading end of the mandrel further comprises a nosepiece, the nosepiece being configured to sealingly engage in a receiving configuration in the subterranean plug.

36. The dart of claim 35 wherein the nosepiece is threadably attached to the mandrel.

37. The dart of claim 35 wherein the nosepiece is integrally formed with the mandrel.

38. The dart of claim 35 wherein the nosepiece is configured with at least one uniquely shaped key that will selectively engage with a matching uniquely shaped profile in the receiving configuration in the subterranean plug.

39. The dart of claim 35 wherein the nosepiece is configured with a latch down profile that will latch into a matching profile within the receiving configuration in the subterranean plug.

40. The dart of claim 35 wherein the nosepiece comprises a drillable material.

41. The dart of claim 40 wherein the drillable material is selected from the group consisting of: aluminum, plastic, brass, a phenolic, a high-strength thermoplastic, glass, and a composite.

42. The dart of claim 34 wherein the foam body comprises a foamable elastomer.

43. The dart of claim 42 wherein the foamable elastomer comprises an open-cell foam.

44. The dart of claim 43 wherein the open cell foam is made from a material selected from the group consisting of: natural rubber, nitrile rubber, styrene butadiene rubber, and polyurethane.

45. The dart of claim 44 wherein the open-cell foam is a low density foam.

46. The dart of claim 35 wherein the nosepiece has a tapered leading end.

47. The dart of claim 34 wherein the mandrel comprises a drillable material.

48. The dart of claim 47 wherein the drillable material is selected from the group consisting of: aluminum, plastic, brass, a phenolic, a high-strength thermoplastic, glass, and a composite.

49. The dart of claim 34 wherein the foam body has a substantially cylindrical shape.

50. The dart of claim 49 wherein the foam body has an outer diameter and a length, the outer diameter being substantially constant along the length of the foam body.

51. The dart of claim 35 wherein the nosepiece has an outer diameter, and wherein the outer diameter of the nosepiece is smaller than the outer diameter of the foam body.

52. The dart of claim 49 wherein the foam body has an outer diameter and a length, the outer diameter varying along the length of the foam body.

53. The dart of claim 52 wherein the foam body comprises a rib or fin.

54. The dart of claim 35 wherein the nosepiece is coated with an elastomeric compound.

55. The dart of claim 35 wherein the nosepiece comprises a seal ring.

56. The dart of claim 35 wherein the nosepiece and the mandrel when combined together have an effective combined length, and wherein their effective combined length exceeds the largest inner diameter of at least one pipe string within a subterranean well bore when the dart is placed therein.

57. The dart of claim 34 wherein the foam body has an outer surface, and wherein the outer surface of the foam body is capable, when placed within a well bore comprising at least one pipe string having an inner diameter and a length, of engaging the inner diameter of the at least one pipe string at any point along the length of the at least one pipe string.

58. The dart of claim 57 wherein the inner diameter of the at least one pipe string varies along its length.

59. The dart of claim 39 wherein the latch down profile comprises a self-energized device.

60. The dart of claim 59 wherein the self-energized device is selected from the group consisting of: a "C" ring, and a collet type latch ring.

61. The dart of claim 34 wherein the elastic tether is made from a material selected from the group consisting of: natural rubber, a synthetic elastomeric rubber, polyurethane, and elastic fabrics.

62. The dart of claim 35 wherein the nosepiece and the mandrel each comprise a drillable material; wherein the foam body comprises a foamable elastomer; wherein the nosepiece and the mandrel each have a length, and wherein the sum of their lengths exceeds the largest inner diameter of at least one pipe string within a subterranean well bore when the dart is placed therein; wherein the foam body has an outer surface, and wherein the at least one pipe string has a length, and wherein the outer surface of the foam body is capable of engaging the inner diameter of the at least one pipe string at any point along the length of the at least one pipe string.

63. A dart for activating a subterranean plug located within a subterranean well bore comprising: a mandrel; and a foam body attached to the mandrel; wherein a leading end of the mandrel further comprises a nosepiece, the nosepiece being configured with at least one uniquely shaped key that will selectively and sealingly engage with a matching uniquely shaped profile in the receiving configuration in the subterranean plug.

64. A dart for activating a subterranean plug located within a subterranean well bore comprising: a mandrel; and a foam body attached to the mandrel; wherein a leading end of the mandrel further comprises a nosepiece, the nosepiece being configured with a latch down profile that will sealingly engage and latch into a matching profile within the receiving configuration in the subterranean plug.

65. The dart of claim 64 wherein the latch down profile comprises a self-energized device.

66. The dart of claim 65 wherein the self-energized device is selected from the group consisting of: a "C" ring, and a collet type latch ring.

67. A method of activating a plug located within a subterranean well bore comprising the step of introducing a dart into a receiving configuration within the plug, wherein the dart comprises a mandrel, a foam body attached to the mandrel, and an elastic tether attached to the mandrel and to the foam body.

68. The method of claim 67 wherein the elastic tether is made from a material selected from the group consisting of: natural rubber, a synthetic elastomeric rubber, polyurethane, and elastic fabrics.

* * * * *